US011142440B2

(12) United States Patent
Maslowski

(10) Patent No.: US 11,142,440 B2
(45) Date of Patent: Oct. 12, 2021

(54) C-SHAPE JACK

(71) Applicant: Jerzy Maslowski, Justice, IL (US)

(72) Inventor: Jerzy Maslowski, Justice, IL (US)

( * ) Notice: Subject to any disclaimer, the term of this patent is extended or adjusted under 35 U.S.C. 154(b) by 328 days.

(21) Appl. No.: 16/440,938

(22) Filed: Jun. 13, 2019

(65) Prior Publication Data

US 2019/0382251 A1 Dec. 19, 2019

Related U.S. Application Data

(60) Provisional application No. 62/684,191, filed on Jun. 13, 2018.

(51) Int. Cl.
*B66F 5/04* (2006.01)

(52) U.S. Cl.
CPC ..... *B66F 5/04* (2013.01)

(58) Field of Classification Search
CPC ..... B66F 5/04
USPC ..... 254/93
See application file for complete search history.

(56) References Cited

U.S. PATENT DOCUMENTS 2,552,965 A * 5/1951 Harris ..... B66F 3/247 254/9 B
4,549,722 A * 10/1985 Gagliano ..... B66F 5/04 254/134
9,180,577 B2 * 11/2015 Heath ..... B25B 11/02

* cited by examiner

*Primary Examiner* — Lee D Wilson
*Assistant Examiner* — Jonathan G Santiago Martinez
(74) *Attorney, Agent, or Firm* — Bruce A. Lev

(57) ABSTRACT

A C-Shape Jack, an accessory pedestal structured and arranged to slide onto the existing saddle of a hydraulic floor jack, and converts that saddle into an arched, C-shape for supporting and lifting cylindrical objects, from axles and spindles to pipes. Easy to use and capable of supporting any load that the jack can handle, the C-Shape Jack would be used by mechanics as well as such construction-industry tradesmen as pipe-fitters, and household do-it-yourselfers.

3 Claims, 3 Drawing Sheets

C-SHAPE JACK

CROSS-REFERENCE TO RELATED APPLICATION

The present application is related to and claims priority from prior provisional application Ser. No. 62/684,191, filed Jun. 13, 2018 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of hydraulic jacks and more specifically relates to a C-Shape Jack, an accessory pedestal structured and arranged to slide onto the existing saddle of a hydraulic floor jack, and converts that saddle into an arched, C-shape for supporting and lifting cylindrical objects, from axles and spindles to pipes.

2. Description of the Related Art

A lifting surface of hydraulic floor-jacks—the saddle or pedestal—is flat, while the object being raised an axle or spindle, or a pipe is often cylindrical or rounded: and what's needed is a safe, efficient means of lifting these. Therefore, a need exists for an accessory structured and arranged to make a hydraulic floor-jack far more versatile, effective, and safe.

Various attempts have been made to solve problems found in hydraulic jacks art. Among these are found in: U.S. Pat. No. 4,549,722 to Victor Gagliano; U.S. Pat. No. 5,127,638 to Cloyce G. Kent; and U.S. Pat. No. 5,181,821 to Connie L. King, Sr. This prior art is representative of hydraulic jacks having C-shaped lifting pads.

Ideally, a C-shaped Jack should be user-friendly and safe in-use and yet would operate reliably and be manufactured at a modest expense. Thus, a need exists for a C Shape-Jack, an accessory pedestal structured and arranged to slide onto the existing saddle of a hydraulic floor jack, and converts that saddle into an arched, C-shape for supporting and lifting cylindrical objects, from axles and spindles to pipes. Easy to use and capable of supporting any load that the jack can handle, the C-Shape Jack would be used by mechanics as well as such construction-industry tradesmen as pipe-fitters, and household do-it-yourselfers to avoid the above-mentioned problems.

BRIEF SUMMARY OF THE INVENTION

In view of the foregoing disadvantages inherent in the known hydraulic jack art, the present invention provides a novel C-Shape Jack. The general purpose of the present invention, which will be described subsequently in greater detail is to provide a C-Shape Jack, an accessory pedestal structured and arranged to slide onto the existing saddle of a hydraulic floor jack, and converts that saddle into an arched, C-shape for supporting and lifting cylindrical objects, from axles and spindles to pipes. Easy to use and capable of supporting any load that the jack can handle, the C-Shape Jack would be used by mechanics as well as such construction-industry tradesmen as pipe-fitters, and household do-it-yourselfers.

A hydraulic jack C-shaped accessory comprising: a C-shaped lifting pad comprising heavy-duty steel channels; and a flat bottom plate with a first C-channel on a left side of the flat bottom plate and a second C-channel on a right side of the flat bottom plate. Wherein the C-shaped lifting pad is twelve inches in length and between three and one half and four inches in depth. Wherein the C-shaped lifting pad is welded, at a center of a base of the C-shaped lifting pad to the flat bottom plate. Wherein the C-shaped lifting pad has a concave arch and is nearly semicircular in shape, forming a concave rest for lifting. Wherein the C-shaped lifting pad has a smaller semicircular groove in the center of the concave arch. Wherein the flat bottom plate is equipped with a first C-channel on the left side of the flat bottom plate and a second C-channel on the right side of the flat bottom plate. Wherein the C-channels are removably attachable to flanges on a left and right side of a hydraulic jack base.

The present invention holds significant improvements and serves as a C-Shape Jack. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, a C-Shape Jack, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a hydraulic jack and more particularly to a C-Shape Jack, an accessory pedestal structured and arranged to slide onto the existing saddle of a hydraulic floor jack, and converts that saddle into an arched, C-shape for supporting and lifting cylindrical objects, from axles and spindles to pipes. Easy to use and capable of supporting any load that the jack can handle, the C-Shape Jack would be used by mechanics as well as such construction-industry tradesmen as pipe-fitters, and household do-it-yourselfers.

Generally speaking, the C-Shape Jack comprising a novel product offering consumers a practical solution to the aforementioned challenges. As the name implies, the C-Shape Jack comprises a specially designed one-piece accessory that converts the flat saddle or pedestal of a standard hydraulic floor-jack into an arched, concave saddle for lifting and supporting curved or cylindrical objects such as axles, spindles, and pipes.

The C-Shape Jack is an arched, nearly semicircular component perhaps 12 inches in length and 3½ to 4 inches in depth fabricated in heavy-duty steel channels and welded, at its center bottom, to a flat bottom plate equipped with C-channels on either side. These C-channels slide onto and over the flanges on the sides of the jack's existing saddle, thus forming a secure, locked anchor and base for the C-Shape Jack, which now takes the place of the jack's saddle or pedestal, and forms a concave rest upon which axles, spindles, or pipes may be lifted and supported.

Figure 1A:
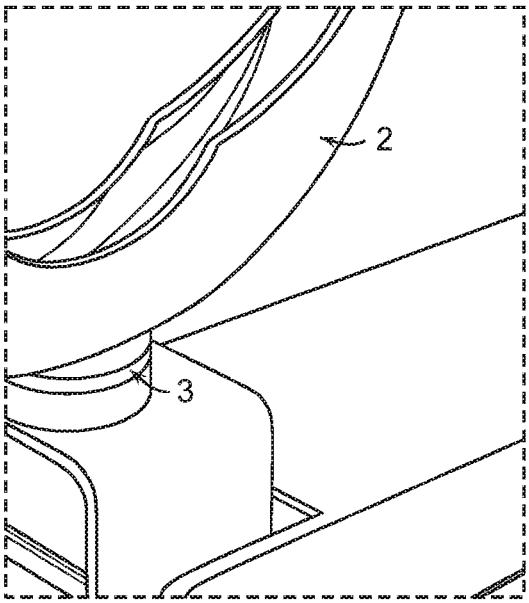
FIG. 1A shows an exploded view illustrating a C-shaped lifting pad of the C-Shape Jack according to an embodiment of the present invention.
Figure 1:
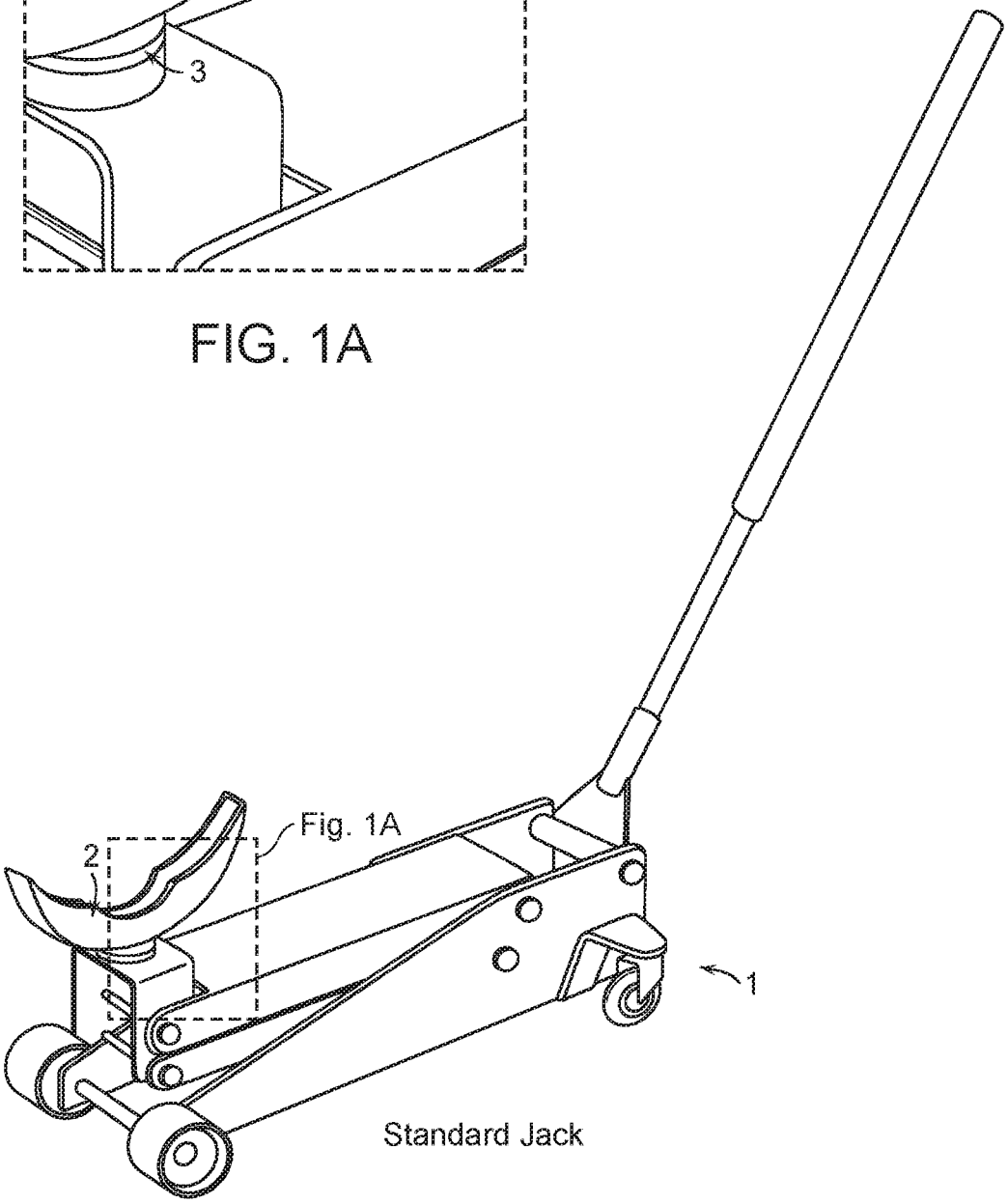
FIG. 1 shows a perspective view illustrating a hydraulic jack including a: hydraulic jack base and a C-shaped lifting pad of the C-Shape Jack according to an embodiment of the present invention.
Figure 2:
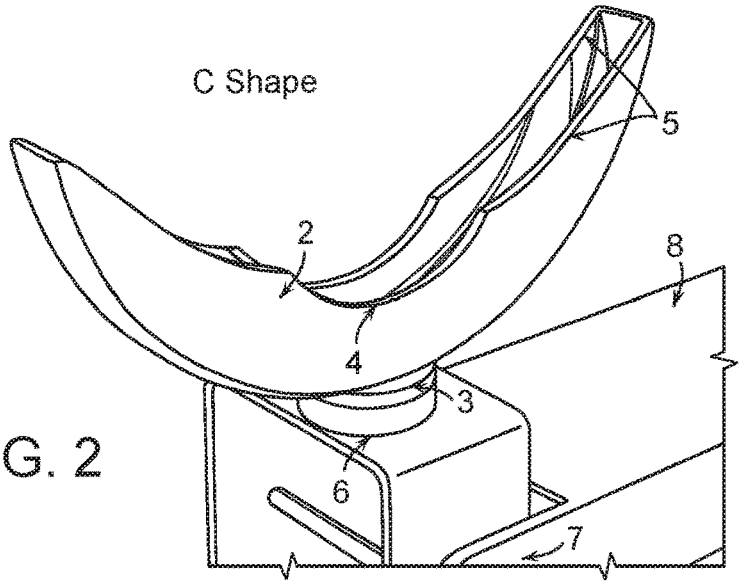
FIG. 2 is a perspective view illustrating a smaller semicircular groove in the center of the arch and heavy-duty steel channels on the C-shaped lifting pad of the C-Shape Jack according to an embodiment of the present invention of FIG. 1.
Figure 3:
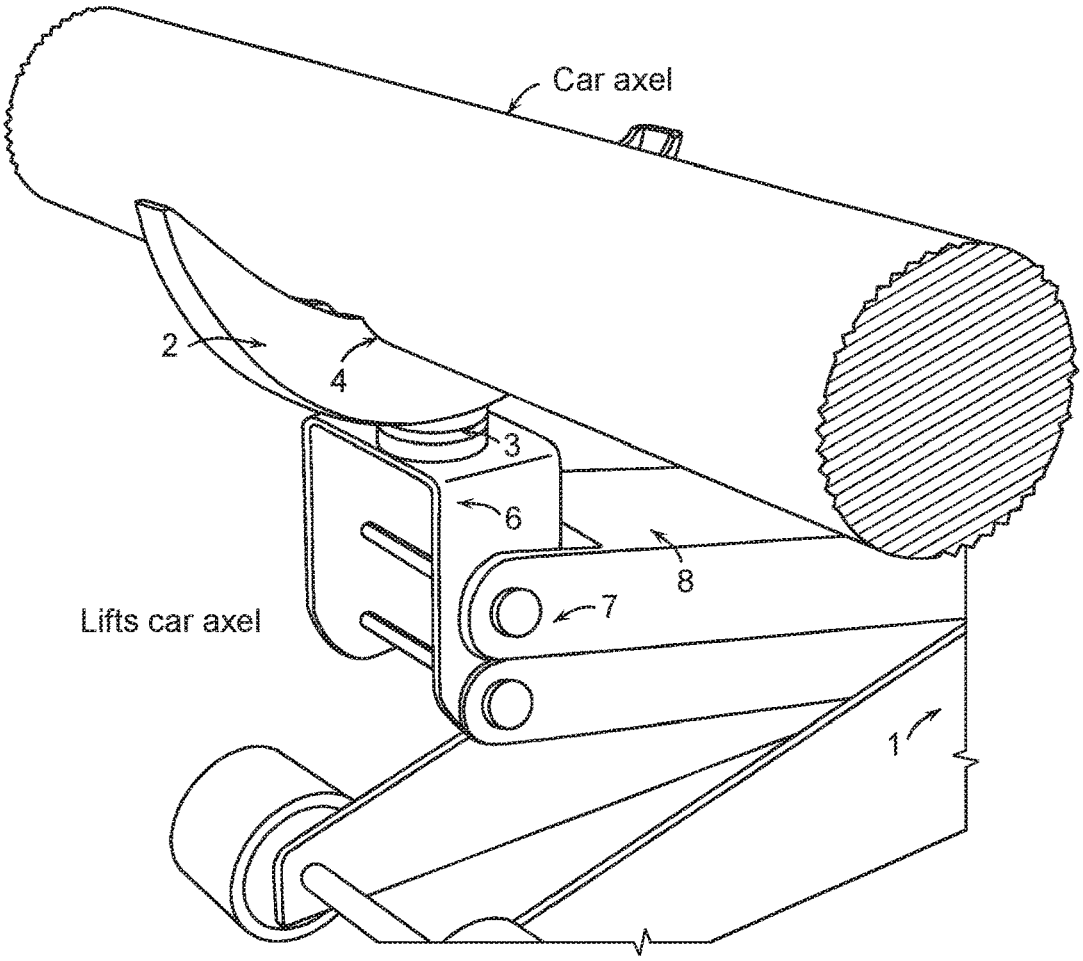
FIG. 3 is a perspective view illustrating the C-Shape Jack in an in-use condition according to an embodiment of the present invention of FIG. 1.
Figure 4:
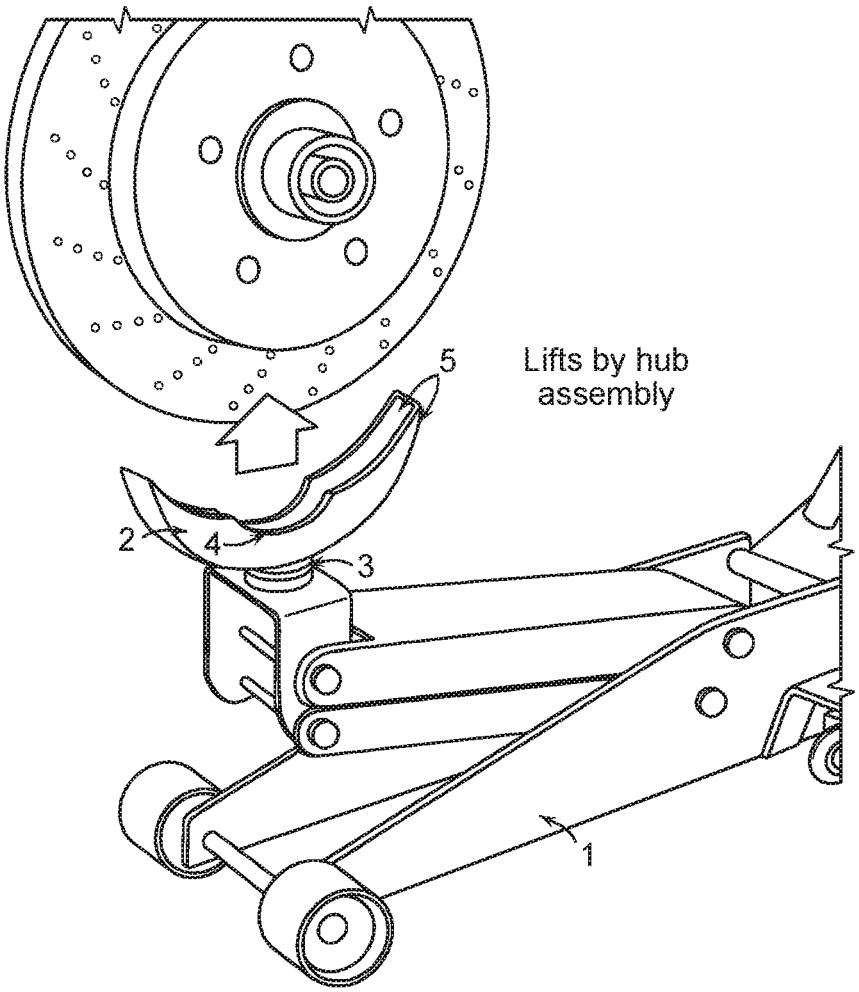
FIG. 4 is a perspective view illustrating another view of the hydraulic jack base and the C-shaped lifting pad C-Shape Jack according to an embodiment of the present invention of FIG. 1.

The C-Shape Jack, then, is an inexpensive accessory that installs easily in moments, and gives a hydraulic floor-jack a range of versatility that it does not otherwise possess. Essential for supporting wheel spindles and sliding away heavy hubs, the C-Shape Jack would make life and work easier for the truck and heavy-equipment mechanic, and the C-Shape Jack would also be incredibly useful to pipefitters, HVAC techs, and any other tradesman who must raise cylindrical or rounded objects, or heavy pipes, as part of their work. Clever in conception, thoughtful in design, and proven in practice, this jack-conversion accessory should find a wide and enthusiastic reception among mechanics, a variety of construction tradesmen, and household do-it-yourselfers Referring to the drawings by numerals of reference there is shown in FIGS. 1-4 illustrating, perspective views illustrating a C-Shape Jack according to an embodiment of the present invention.

A hydraulic jack comprising: hydraulic jack base 1; C-shaped lifting pad 2; and flat bottom plate 6 with a first C-channel on a left side of the flat bottom plate and a second C-channel on a right side of the flat bottom plate. Wherein C-shaped lifting pad 2 is welded, at a center of a base 3 of C-shaped lifting pad 2 to flat bottom plate 6. Wherein the C-channels of flat bottom plate 6 are removably attachable to hydraulic jack base 1. Wherein hydraulic jack base 1 has saddle 8 with a right side flange and a left side flange 7, and wherein the C-channels of flat bottom plate 6 slide over the flanges of saddle 8 and securely lock in place.

A hydraulic jack C-shaped accessory comprising: C-shaped lifting pad 2 and a flat bottom plate 6 with a first C-channel on a left side of the flat bottom plate and a second C-channel on a right side of the flat bottom plate. Wherein the C-shaped lifting pad 2 is welded, at a center of a base of the C-shaped lifting pad to flat bottom plate 6. Wherein C-shaped lifting pad 2 forms a concave rest for lifting, Wherein the C-shaped lifting pad 2 is arched and nearly semicircular and has a smaller semicircular groove 4 in the center of the arch, Wherein the flat bottom plate 6 is equipped with a first C-channel on the left side of the flat bottom plate and a second C-channel on the right side of the flat bottom plate. Wherein the C-channels are removably attachable to hydraulic jack base 1. Wherein C-shaped lifting pad 2 is twelve inches in length and between three and one half and four inches in depth. Wherein C-shaped lifting pad 2 comprises heavy-duty steel channels.

A hydraulic jack C-shaped accessory comprising: C-shaped lifting pad 2 comprising heavy-duty steel channels; and flat bottom plate 6 with a first C-channel on a left side of the flat bottom plate and a second C-channel on a right side of the flat bottom plate. Wherein C-shaped lifting pad 2 is twelve inches in length and between three and one half and four inches in depth. Wherein C-shaped lifting pad 2 is welded, at center of a base 3 of C-shaped lifting pad 2 to flat bottom plate 6. Wherein C-shaped lifting pad 2 has a concave arch and is nearly semicircular in shape, forming a concave rest for lifting. Wherein C-shaped lifting pad 2 has smaller semicircular groove 4 in the center of the concave arch. Wherein flat bottom plate 6 is equipped with a first C-channel on the left side of the flat bottom plate and a second C-channel on the right side of the flat bottom plate. Wherein the C-channels are removably attachable to flanges on a left and right side 7 of a hydraulic jack base 1.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A hydraulic jack comprising:

(a) a hydraulic jack base;

(b) a C-shaped lifting pad; and (c) a flat bottom plate with a first C-channel on a left side of the flat bottom plate and a second C-channel on a right side of the flat bottom plate, wherein the hydraulic jack base has a saddle with a right side flange and a left side flange, and wherein the C-channels of the flat bottom plate slide over the flanges of the saddle and securely lock in place, wherein the C-shaped lifting pad forms a concave rest for lifting, wherein the C-shaped lifting pad is arched and nearly semicircular and has a smaller semicircular groove in the center of the arch.

2. The hydraulic jack C-shaped accessory of claim 1, wherein the C-shaped lifting pad is twelve inches in length and between three and one half and four inches in depth.

3. The hydraulic jack C-shaped accessory of claim 1, wherein the C-shaped lifting pad comprises heavy-duty steel channels.

* * * * *